US005743968A

United States Patent [19]

Leeker et al.

[11] Patent Number: 5,743,968

[45] Date of Patent: *Apr. 28, 1998

[54] HYDROGEN PEROXIDE PICKLING OF STAINLESS STEEL

[75] Inventors: Jerald W. Leeker, Trenton; Ronald D. Rodabaugh, Lebanon, both of Ohio

[73] Assignee: Armco Inc., Middletown, Ohio

[ * ] Notice: The term of this patent shall not extend beyond the expiration date of Pat. No. 5,702,534.

[21] Appl. No.: 821,154

[22] Filed: Mar. 20, 1997

[51] Int. Cl.[6] ..... C23G 1/02; B08B 1/02

[52] U.S. Cl. ..... 134/2; 134/3; 134/15; 134/28; 134/41

[58] Field of Search ..... 134/2, 3, 10, 28, 134/29, 41, 15

[56] References Cited

U.S. PATENT DOCUMENTS

| | | | |
|---|---|---|---|
| 3,489,625 | 1/1970 | Dell et al. | 134/2 |
| 5,154,774 | 10/1992 | Bousquet et al. | 134/3 |
| 5,292,374 | 3/1994 | Maresch et al. | 134/26 |

FOREIGN PATENT DOCUMENTS

| | | |
|---|---|---|
| 54-064022 | 5/1979 | Japan . |
| 60-243289 | 3/1985 | Japan . |
| 63-20494 | 1/1988 | Japan . |

*Primary Examiner*—Jill Warden
*Assistant Examiner*—Saeed Chaudhry
*Attorney, Agent, or Firm*—R. J. Bunyard; L. A. Fillnow

[57] ABSTRACT

A process for removing scale from stainless steel using an aqueous solution containing hydrogen peroxide and an inorganic acid, i.e., hydrochloric or sulfuric acid. A hot rolled or annealed stainless steel strip (10) covered with scale is immersed into hot inorganic acid contained within pickling tanks (12) and (14). Thereafter, the strip may have residual amounts of tightly adherent scale (11). This scale is activated by a solution containing the inorganic acid and hydrogen peroxide applied to the strip such as by a spray header (16) extending completely transversely across and positioned above the strip and another spray header (18) extending completely transversely across and positioned below the strip. It may be desirable to pass the activated strip through the hot inorganic acid again and reactivate the strip at very high line speeds to insure complete removal of scale from the strip. Any hydrogen peroxide spray dripping from the strip is collected on a catch pan (30) and flowed into a tank (28). Preferably, the collected spent aqueous solution containing the inorganic acid and spent hydrogen peroxide is disposed in the pickling tanks. The aqueous solution aids in the removal of any residual scale and smut remaining on the strip thereby improving the cleanliness of the pickled strip.

19 Claims, 3 Drawing Sheets

HYDROGEN PEROXIDE PICKLING OF STAINLESS STEEL

BACKGROUND OF THE INVENTION

This invention relates to a process for acid descaling ferrous alloys containing chromium. More specifically, oxide on hot rolled or annealed ferrous alloys containing chromium is removed by sequentially immersing the alloy in an inorganic acid and then applying an aqueous solution containing hydrogen peroxide to the pickled alloy.

One of the most environmentally intensive problems relating to steel manufacturing is pickling of steel to remove oxide or scale formed during hot processing such as rolling on a hot strip mill or annealing. Most low carbon steels may be descaled in hydrochloric acid at high speeds. The scale on stainless steel, however, has a very fine structure and is tightly adherent usually requiring mechanical scale cracking such as shot blasting, roll bending or roll leveling of a steel strip to loosen the scale prior to acid pickling. Additionally, stainless steel pickling acids such as hydrofluoric, sulfuric, nitric or mixtures thereof generally must be more aggressive than those required for low carbon steel. The immersion time required for stainless steel is much longer than that required for low carbon steel and may require electrical assistance to help remove the scale as well. A major motivation for improving the scale removing process is the capital and environmental disposal costs associated with pickling acids. A major disadvantage of chemical descaling using hydrofluoric and nitric acids is the environmental problems related to their disposal.

It is known to use acid mixtures containing hydrogen peroxide for pickling and cleaning stainless steel. For example, U.S. Pat. No. 5,154,774 teaches adding an oxygenated agent, e.g., hydrogen peroxide, potassium permanganate or air, to a hydrofluoric acid for pickling stainless steel to convert ferrous ions to ferric ions. U.S. Pat. No. 5,164,016 teaches adding hydrogen peroxide to an organic acid such as formic, acetic, propionic, lactic, benzoic, phthalic and naphthoic for pickling stainless steel. Hydrogen peroxide is added to the acid to control the ratio of ferrous/ferric ions within the range of 10/90 to 40/60.

Japanese patent application 63-20494 discloses a method for chemically removing scale from stainless steel by adding an adhesive to a solution containing hydrogen peroxide, phosphoric acid and hydrogen fluoride. The adhesive is not decomposed by the hydrogen peroxide and gives viscosity to the cleaning solution and forms a pasty liquid. Japanese patent application 60-243289 discloses reducing smut on steel using an acid bath containing hydrofluoric acid, hydrogen peroxide and hydrochloric or sulfuric acid. Japanese patent application 54-64022 discloses providing a viscous pickling agent for removing stain and scale from stainless steel. Abrasive particles such as alumina, Cr oxide, Si carbide or silica are added to an acidic solution containing hydrogen peroxide, sulfuric acid, hydrochloric acid and a surfactant agent. Japanese patent application 58-110682 discloses pickling hot rolled stainless steel with a solution containing sulphamic acid, nitric acid, hydrofluoric acid and hydrogen peroxide.

Although these acids are effective for removing scale from stainless steel, their use creates certain undesirable problems and have their limitations. For example, using sulfuric acid alone for removing scale from stainless steel is undesirable because this acid leaves a black smut on the pickled steel. Using hydrochloric acid alone results in a bright stainless steel surface but is undesirable because of slow reaction with the tightly adhering scale. More aggressive acids such as nitric and hydrofluoric to remove scale from stainless steel are especially undesirable because their use creates environmental problems requiring fume abatement equipment to handle fumes from the pickling tanks, special equipment for storing the acids, and their pickling by-products require special handling and costly disposal. Other disadvantages include safety and health risks associated from chronic exposure to these acids and limits on allowable nitrate and fluoride discharge in effluents from treated wastes. An organic acid is undesirable because it would not be useful for descaling of a stainless steel.

Pending patent application U.S. Ser. No. 08/667,498; filed May 24, 1996; entitled "Hydrogen Peroxide Pickling Of Stainless Steel", incorporated herein by reference, relates to a process for removing scale from a ferrous alloy containing chromium. This process includes pretreating the ferrous alloy to crack the scale, immersing the alloy into a tank containing a pickling acid to remove the cracked scale, applying an aqueous solution containing hydrogen peroxide to the pickled alloy so that any residual scale on the alloy becomes activated by the peroxide. The activated strip then is immersed into another tank containing an acid to remove any residual scale.

Accordingly, there remains a need for a process for pickling ferrous alloys containing chromium that does not include nitric acid, hydrofluoric acid or a fluoride compound. There remains a further need for a process for pickling ferrous alloys containing chromium that does not create costly environmental disposal problems of pickling waste by-products. Another need includes being able to obviate the need for expensive pollution control and waste treatment facilities associated with using nitric acid, hydrofluoric acid or a fluoride compound.

BRIEF SUMMARY OF THE INVENTION

A principal object of the invention is to provide a ferrous alloy containing chromium having a bright, oxide free surface, using a hydrochloric or sulfuric pickling solution whose by-products do not cause an environmental disposal problem.

Another object of the invention is to provide a ferrous alloy containing chromium having a bright, oxide free surface without using nitric acid, hydrofluoric acid or a fluoride compound.

Another object of the invention includes providing a hydrochloric or sulfuric pickling process wherein the chemical cost is no greater than that otherwise required for nitric, hydrofluoric acid or a fluoride compound.

Another object of the invention is to pickle a ferrous alloy strip containing chromium at a speed of at least 30 m/min.

The invention relates to a hot rolled or annealed ferrous alloy strip containing chromium being descaled with an acid. The hot rolled or annealed ferrous alloy strip is pretreated to crack the scale and then immersed into a pickling tank containing an inorganic acid from the group consisting of hydrochloric or sulfuric acid to remove the cracked scale. Thereafter, an aqueous solution containing hydrogen peroxide is applied to the pickled alloy strip wherein any residual scale becomes activated by the peroxide so that the residual scale can be removed by the inorganic acid thereby providing a clean chromium ferrous alloy strip.

Another feature of the invention is for the aforesaid aqueous solution to contain at least about 20 g/l hydrogen peroxide.

Another feature of the invention is for the aforesaid aqueous solution to contain the inorganic acid for removing the residual scale.

Another feature of the invention is for the aforesaid aqueous solution to contain at least about 5 g/l of the inorganic acid.

Another feature of the invention is for the aforesaid aqueous solution being disposed of in the pickling tank.

Another feature of the invention is for the aforesaid pickling tank to contain at least about 50 g/l of the inorganic acid.

Another feature of the invention is for the aforesaid pickling tank acid to have a temperature of at least about 60° C.

An advantage of the invention includes using hydrochloric or sulfuric acid for removing hot roll mill scale or annealing scale from a ferrous alloy strip containing chromium rather than using nitric acid, hydrofluoric acid or fluoride compounds. Another advantage of the invention includes increased pickling speeds without using nitric acid, hydrofluoric acid or fluoride compounds. Other advantages include fewer environmental concerns, a hydrogen peroxide containing waste solution being compatible with hydrochloric or sulfuric acid waste by-products, a smut free chromium alloyed strip, obviating the need for electrical assistance for removing scale and a more passive corrosion resistant pickled ferrous chromium alloyed surface.

The above and other objects, features and advantages of the invention will become apparent upon consideration of the detailed description and appended drawings.

DETAILED DESCRIPTION OF THE PREFERRED EMBODIMENT

Figure 1:
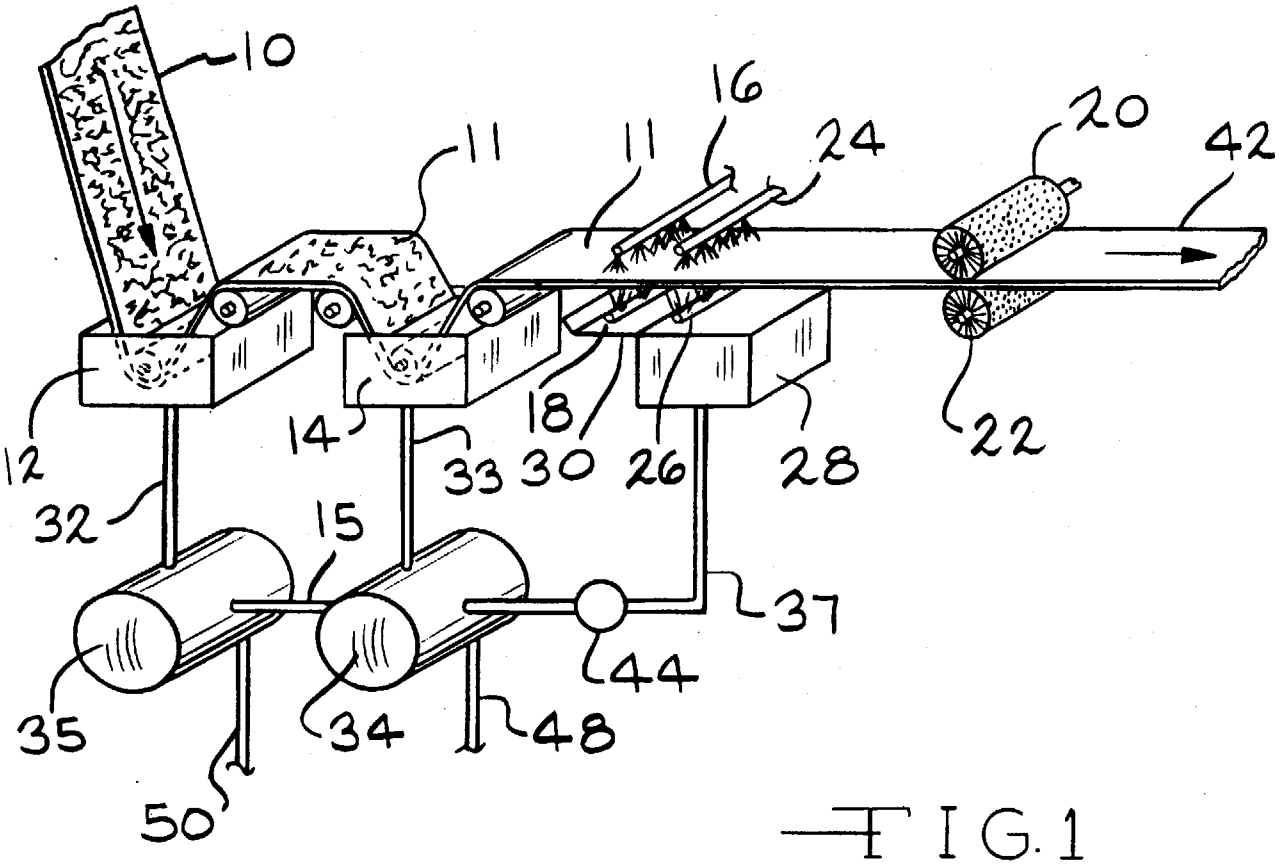
FIG. 1 schematically illustrates a pickling line incorporating the process of the invention, FIG. 2 schematically illustrates another embodiment of a pickling line incorporating the process of the invention, and FIG. 3 schematically illustrates another embodiment of means for applying an inorganic acidic solution containing hydrogen peroxide of the invention to a pickled ferrous alloy strip containing chromium.

This invention relates to a process using inorganic acid for descaling a ferrous alloy containing chromium, such as ferritic stainless steel strip. More specifically, oxide or scale, hereafter referred to as scale, on a hot rolled or an annealed ferrous alloy containing chromium is removed by immersing the alloy into an inorganic acid of hydrochloric (HCl) or sulfuric acid ($H_2SO_4$), and then rinsing the pickled strip with an aqueous solution containing hydrogen peroxide ($H_2O_2$). Any residual scale remaining on the strip is activated by the hydrogen peroxide contained in the aqueous rinsing solution and then removed by inorganic hydrochloric or sulfuric acid. The inorganic acid can be sprayed onto the strip after activation by the hydrogen peroxide, the activated strip can be immersed into a tank containing the inorganic acid or preferably the inorganic acid is contained in the aqueous solution containing the hydrogen peroxide rinsing.

By activating any residual scale with a solution containing hydrogen peroxide, it has been determined the use of nitric or hydrofluoric acids and/or fluoride containing compounds is not required to adequately remove scale from ferrous alloys containing chromium during high speed pickling. Not being bound by theory, what is meant by activating the scale is that hydrogen peroxide reacts with the base metal of the steel alloy to loosen and/or decompose the scale tightly adhering thereto thereby aiding in the removal of the scale from the substrate by the inorganic acid.

By a ferrous alloy containing chromium is meant an alloy of iron and chromium, e.g., chromium alloyed steel, stainless steel, in which the chromium content is at least about 5% Cr, preferably at least 10% Cr and up to about 30% Cr. The alloy preferably is a ferritic stainless steel including up to about 0.5% Al, up to about 0.3% of C, up to about 1% of one or more of Si, Ti, Nb, Zr; up to about 5% of Ni and/or Mo and up to about 1.5% Mn. All percentages are by wt. %. These alloys also may include purposeful additions of one or more of Ta, Ca, Cu, B and N as well.

After a scale is formed during hot processing such as by rolling on a hot strip mill or in a continuous annealing furnace, continuous stainless steel strip or foil or cut to length sheets, referred to hereafter as strip, is given a mechanical scale cracking treatment such as shot blasting or roll bending to loosen the scale. Thereafter, the strip is immersed into a pickling tank containing an inorganic acid to remove the cracked scale. For this invention, the inorganic acid is defined to include either of sulfuric acid or hydrochloric acid. An important feature of the invention is to thereafter apply an aqueous solution containing hydrogen peroxide and inorganic acid onto the pickled strip wherein any remaining residual scale, smut, dirt, and the like becomes activated by the hydrogen peroxide and simultaneously removed by the inorganic acid in the aqueous solution containing the hydrogen peroxide. Preferably, the pickling tank contains the same inorganic acid as that used to remove the residual scale. This remaining scale then becomes removed when the strip is rinsed with the solution containing the inorganic acid and hydrogen peroxide and when the strip then is brushed and rinsed with water.

The pickling tank contains the inorganic acid so that the spent aqueous solution containing hydrogen peroxide and inorganic acid can be disposed of in the pickling tank after being used to activate and aid in the removal of any residual scale on the strip. Considerable make up solution is required in the pickling tank because of evaporation when the acid is hot. The aqueous solution advantageously can be disposed of by being sent to the pickling tank as part of this make up requirement.

Hydrogen peroxide rapidly reacts with ferrous iron ($Fe^{+2}$) resulting in ferric iron ($Fe^{+3}$) when iron is removed from steel strip and becomes dissolved into a solution containing the hydrogen peroxide. For this reason, the hydrogen peroxide of the invention preferably is dissolved into a hydrochloric or sulfuric acid and applied directly to the surface of the strip rather than being stored within an immersion tank. If the peroxide were dissolved within the inorganic acid stored within an immersion tank, the peroxide would break down and become ineffective after a relatively short period of time no longer activating any residual scale remaining on the pickled strip. Hydrogen peroxide is consumed when ferrous ions ($Fe^{+2}$) dissolved in the inorganic acid are oxidized to ferric ions ($Fe^{+3}$).

It was surprisingly discovered any residual scale advantageously need only remain in contact with an aqueous solution containing hydrogen peroxide and inorganic acid a very short period of time to become sufficiently activated by the hydrogen peroxide thereby easily being simultaneously removed by the inorganic acid contained within the aqueous solution. By simultaneously removing any residual scale from the strip is meant using an activation time as short as about 1 second, preferably at least 3 seconds and more preferably less than 10 seconds. A major advantage of this invention is that it is not necessary to apply the inorganic acid to the steel strip for removing residual scale apart from the hydrogen peroxide.

FIG. 1 illustrates one embodiment of a pickling line incorporating the process of the invention. More specifically, reference numeral 10 schematically illustrates a ferrous alloy strip containing chromium such as stainless steel covered with a scale such as from rolling on a hot strip mill. The scale on strip 10 would have been cracked such as being passed through a shot blasting machine or roll leveler (not shown). The scale of a stainless steel should be loosened whenever nitric, hydrofluoric acid and/or fluoride compounds are not used to enhance the descaling effect. Thereafter, the strip is immersed into sulfuric or hydrochloric acid contained within one or more pickling tanks such as tanks 12 and 14. If the pickling line of the invention includes a plurality of pickling tanks, the acid in the pickling tanks preferably is counter current flowed such as through a pipe 15 through the tanks in a direction opposite the direction of travel of the strip. Thereafter, the strip normally may have residual amounts of tightly adherent scale 11. This tightly adherent residual scale is activated by being contacted with an aqueous solution containing hydrogen peroxide and then removed by hydrochloric or sulfuric acid. This aqueous solution may be sprayed onto the strip such as by a spray header 16 extending completely transversely across and positioned above the strip and another spray header 18 extending completely transversely across and positioned below the strip. Preferably, another pair of spray headers 24 and 26 extending transversely completely across the strip is provided. Using multiple spray headers above and below the strip increases the activation time of the tightly adherent residual scale by the hydrogen peroxide. Ferrous alloy strip containing chromium having a very clean surface was pickled at a speed of at least 30 m/min. Any peroxide spray dripping from the strip may be collected onto a catch pan 30 and flowed into a tank 28. If it is desired to apply the hydrochloric or sulfuric acid to the strip separately from the aqueous solution, another pair of spray headers can be positioned a short distance down stream from spray headers 24 and 26 for this purpose. Any hydrochloric or sulfuric acid spray dripping from the strip may then also be collected onto catch pan 30 and flowed into tank 28. After the hydrogen peroxide rinse, it is desirable to abrade the pickled steel strip by one or more pairs of brushes 20 and 22. These brushes are of a grit impregnated polymer construction. The strip also will be rinsed with water. If the acid in tanks 12 and 14 is sulfuric, a black smut may remain on the strip surface exiting from tank 14. This smut is easily removed from the strip by the inorganic acid contained in the hydrogen peroxide solution to improve the cleanliness of a cleaned strip 42.

When tanks 12 and 14 contain hydrochloric acid, a collected sprayed hydrogen peroxide solution containing hydrochloric acid can be disposed of in either of tanks 34 and 35 as makeup for liquid lost to evaporation through pipes 32 and 33 respectively. The used acidic hydrogen peroxide solution can flow by gravity to tanks 34 and 35 through a line 37 by opening a valve 44. After the acid becomes saturated with iron, this acid is replaced with fresh acid. Spent acid may be periodically withdrawn from tanks 34 and 35 through a line 50 and sent to an acid recovery plant (not shown). Fresh acid would be returned to tanks 34 and 35 through a return line 48. The fresh acid, along with the used aqueous solution originally containing the hydrogen peroxide, would be pumped from tank 34 to pickling tank 14.

Figure 2:
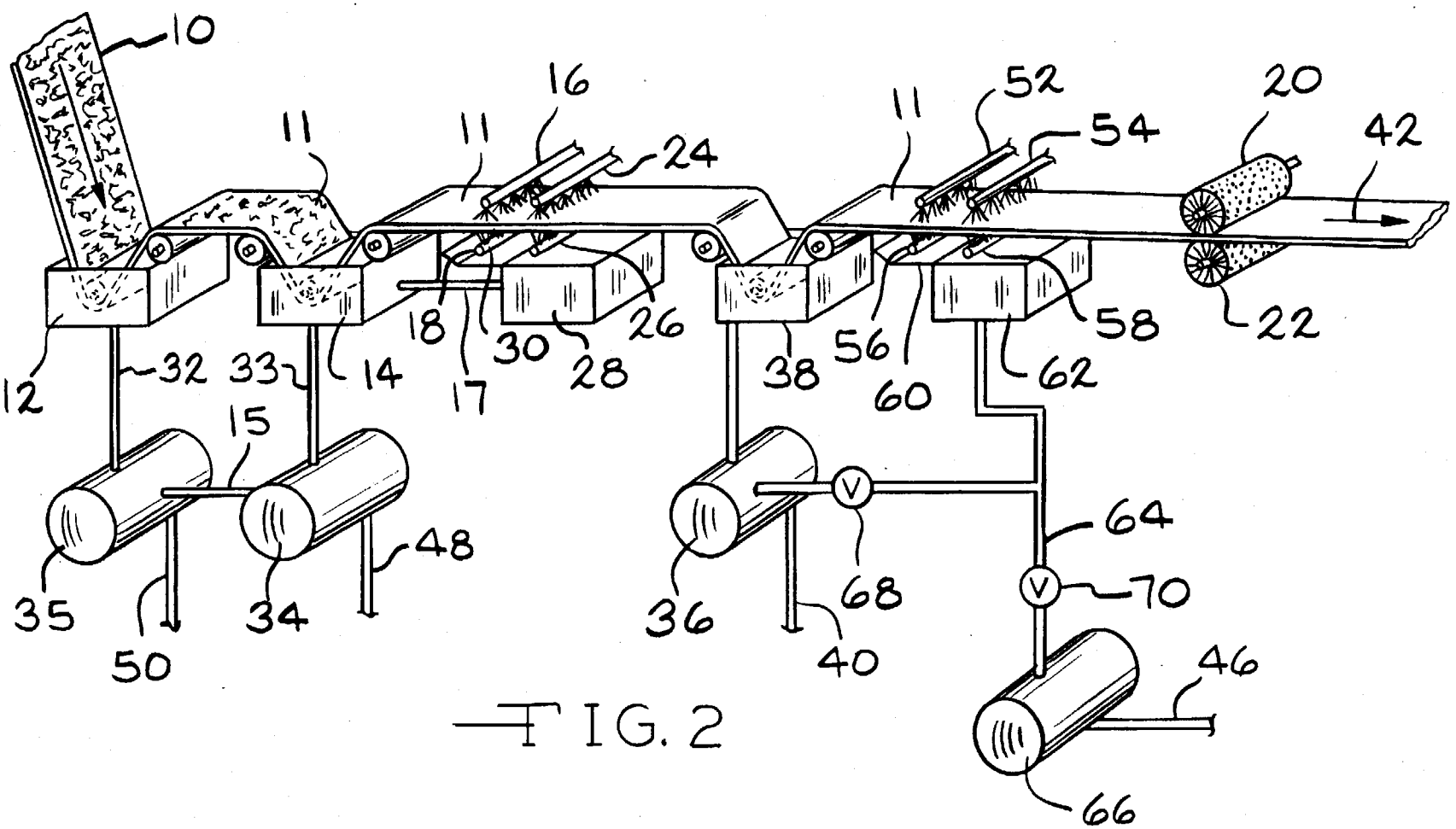

FIG. 2 illustrates another embodiment of a pickling line incorporating the process of the invention. In this embodiment, components that are the same as in the embodiment illustrated in FIG. 1 have like numerals. If scale 11 on strip 10 is extremely adherent and/or it is desired to operate the pickling line at very high speeds, it may be necessary to repickle the strip by passing the pickled strip through another tank 38 containing inorganic acid. Thereafter, if the strip still has any residual scale 11, this remaining scale is reactivated by the aqueous solution containing the inorganic acid and hydrogen peroxide sprayed onto the strip by a second set of multiple spray headers 52, 54 extending completely transversely across and positioned above the strip and another set of multiple spray headers 56, 58 extending completely transversely across and positioned below the strip. By using a second set of multiple spray headers above and below the strip, the activation time of the residual scale by the hydrogen peroxide is twice as long and insures a very bright strip 42 so that a ferrous alloy strip containing chromium can be pickled to a very clean surface at speeds in excess of 30 m/min. Any peroxide spray dripping from the strip at this second set of spray headers may be collected onto a catch pan 60 and flowed into a tank 62. Thereafter, the pickled steel strip is abraded by brushes 20 and 22 and rinsed with water. Used peroxide solution can flow by gravity from tank 62 to a tank 36 by opening a valve 68. Alternatively, the spent peroxide solution can be pumped to a waste water holding tank 66 though a line 64 by opening a valve 70. The waste water in holding tank 66 may then be sent to a waste water treatment plant (not shown) though a line 46. The acid solution in tank 36 may be pumped to the acid recovery plant though a line 40.

In the embodiment of FIG. 2, the aqueous solution containing spent hydrogen peroxide collected in tank 28 is flowed into and disposed of in acid tank 14 through a line 17. Since the inorganic acid in pickling tank 14 contains dissolved iron, any hydrogen peroxide remaining in the aqueous solution will break down into water and oxygen.

Figure 3:
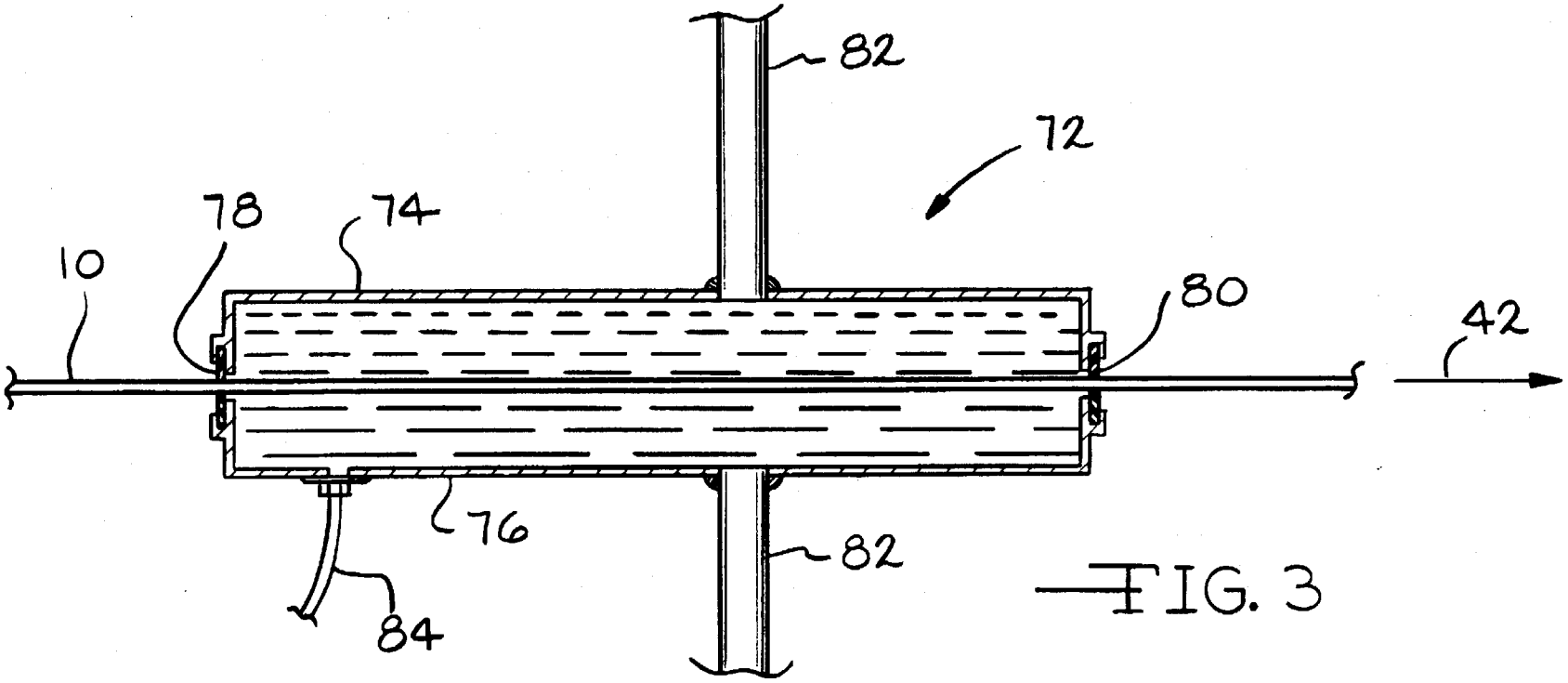

Other means for applying the aqueous solution containing hydrogen peroxide to the pickled steel may include using laminar flow or an absorbent contact roller for contacting each side of a steel strip. FIG. 3 illustrates another embodiment for applying the aqueous solution containing peroxide to the pickled steel using laminar flow. The pickled strip is passed through means 72 for laminar flowing the aqueous solution. Laminar flow means 72 includes a pair of juxtaposed panels 74 and 76 sealably joined to a strip entry end 78 and a strip exit end 80. Ends 78 and 80 include squeegee type wipers for sealing the ends of the applicator. The aqueous solution containing hydrogen peroxide is pumped into laminar flow means 72 through a line 82. The steel strip would be immersed into the aqueous solution. Spent aqueous solution would be continuously withdrawn from laminar flow means 72 through a line 84 for disposal to one of the acid tanks to prevent accumulation of dissolved iron.

An important feature of this invention is that the aqueous solution containing the hydrogen peroxide must be metered onto the pickled strip such as by a spray header, laminar flow or using a contact roller rather than being contained within an immersion tank. Hydrogen peroxide readily oxidizes ferrous iron to ferric iron. If a pickled steel strip were to be continuously immersed into a tank containing the aqueous peroxide solution, the solution would continuously dissolve iron from the steel strip thereby continuously consuming the hydrogen peroxide. This would result in a very inefficient use and wasting of hydrogen peroxide. It is important not to contaminate the aqueous solution containing hydrogen peroxide with iron, e.g., ferrous ions, prior to the aqueous solution being applied to the pickled steel strip.

Another important feature of the invention is that any waste waters containing the spent aqueous solution containing the hydrogen peroxide and inorganic acid not contain free hydrogen peroxide. When hydrogen peroxide is present and the pH of the solution is at least equal to about 7, trivalent chromium, i.e., $Cr^{+3}$, is readily oxidized to hazardous hexavalent chromium, i.e., $Cr^{+6}$. Trivalent chromium can be readily precipitated as an environmentally safe insoluble chromium hydroxide whereas hazardous hexavalent chromium tends to remain soluble and can not be safely disposed such as in an unsecured landfill. Accordingly, the spent aqueous solution containing the inorganic acid and hydrogen peroxide will be mixed with waste water containing dissolved ferrous iron or spent inorganic acid containing dissolved ferrous iron to break down the spent hydrogen peroxide into water and oxygen.

The strip is initially pickled in tanks 12, 14 and 38 in a hot inorganic acid such as hydrochloric or sulfuric maintained at a temperature of at least 60° C. Preferably, the strip is pickled at a temperature of at least 77° C., more preferably at least 82° C. and most preferably at least 88° C. in hydrochloric acid in pickling tanks 12, 14 and 38. Preferably, the hydrochloric acid is maintained at 50 g/l, more preferably at least 75 g/l and most preferably at least 100–200 g/l.

The concentration of the hydrogen peroxide in the aqueous solution should be at least 20 g/l. If it is not at least 20 g/l, the peroxide will not effectively activate stainless steel scale. Preferably, the hydrogen peroxide concentration in the aqueous solution will be at least 25 g/l, more preferably, at least 30 g/l and most preferably at least 40 g/l. The hydrogen peroxide preferably is dissolved in an aqueous solution containing at least 5 g/l of inorganic acid. Preferably, the aqueous solution will contain at least 20 g/l inorganic acid, more preferably, at least 40 g/l inorganic acid and most preferably at least 50 g/l inorganic acid.

EXAMPLE 1

By way of an example, a 409 type stainless steel was hot rolled on a continuous strip mill and then pretreated in a shot blasting machine. Thereafter, the steel strip was pickled in a solution containing 150 g/l hydrochloric acid heated to 82° C. and processed at a speed of 20 m/min. After being pickled in the hot hydrochloric acid, the strip was sprayed for about 2 seconds with an aqueous solution containing 50 g/l of hydrochloric acid and 50 g/l $H_2O_2$. This activated strip then was brushed and rinsed with water. The strip contained no visible scale or smut. The strip processed according to the invention had a very bright appearance and resulted in a steel acceptable for all exposed applications. This example demonstrates the importance of adding the hydrogen peroxide to the aqueous hydrochloric acid solution to obtain a clean surface free of smut and scale. This trial also demonstrates that had the strip been pickled using three acid tanks instead of just one, the line speed could have been increased to 60 m/min.

EXAMPLE 2

In another example, a 409 type stainless steel was hot rolled on a continuous strip mill and then pretreated in a shot blasting machine. Thereafter, the steel strip was pickled in two acid tanks each containing a solution containing 250 g/l sulfuric acid heated to 112° C. and processed at a speed of 40 m/min. After being pickled in the hot sulfuric acid, the strip was sprayed for about 2 seconds with an aqueous solution containing 40 g/l of sulfuric acid and 40 g/l $H_2O_2$. This activated strip then was brushed and rinsed with water. The strip contained no visible scale or smut. The strip processed according to the invention had a very bright appearance and resulted in a steel acceptable for all exposed applications.

EXAMPLE 3

In another example, a 409 type stainless steel was hot rolled on a continuous strip mill and then pretreated in a shot blasting machine. Thereafter, the steel strip was pickled in two acid tanks each containing a solution containing 250 g/l sulfuric acid heated to 112° C. and processed at a speed of 60 m/min. After being pickled in the hot sulfuric acid, the strip was sprayed for about 2 seconds with an aqueous solution containing 40 g/l of sulfuric acid and 40 g/l $H_2O_2$. After being brushed and rinsed with water, this activated strip then was immersed again in an acid tank containing a solution containing 150 g/l hydrochloric acid heated to 82° C. After being pickled in the hot hydrochloric acid, the strip was sprayed again for about 2 seconds with an aqueous solution containing 40 g/l of sulfuric acid and 40 g/l $H_2O_2$. This activated strip then was brushed and rinsed with water. The strip contained no scale or smut. The strip processed according to the invention was fully descaled, totally free of smut, with a bright appearance and resulted in a steel acceptable for all exposed applications.

It will be understood various modifications may be made to the invention without departing from the spirit and scope of it. Therefore, the limits of the invention should be determined from the appended claims.

What is claimed is:

1. A process for removing scale from a ferrous alloy containing chromium, comprising:

providing a ferrous alloy strip containing chromium covered by scale, pretreating the strip to crack the scale, immersing the pretreated strip into at least one pickling tank containing an inorganic acid from the group consisting of hydrochloric and sulfuric acid to remove the cracked scale thereby forming a pickled strip, and applying an aqueous solution free of dissolved iron containing hydrogen peroxide to the pickled strip wherein any residual scale on the pickled strip becomes activated by the hydrogen peroxide and removed by the inorganic acid thereby forming a clean strip.

2. The process of claim 1 wherein the aqueous solution contains at least about 20 g/l of the hydrogen peroxide.

3. The process of claim 1 wherein the aqueous solution contains the inorganic acid.

4. The process of claim 3 wherein the aqueous solution contains at least about 5 g/l of the inorganic acid.

5. The process of claim 3 wherein the aqueous solution contains at least about 20 g/l of the inorganic acid and at least about 25 g/l of the hydrogen peroxide.

6. The process of claim 5 wherein the aqueous solution after activating the strip is disposed of in the pickling tank.

7. The process of claim 5 wherein the pickling tank contains at least about 50 g/l of the inorganic acid at a temperature of at least 60° C.

8. The process of claim 1 wherein the pickling tank contains 100–200 g/l of the inorganic acid.

9. The process of claim 1 including a second pickling tank, the second tank containing at least about 50 g/l of the inorganic acid at a temperature of at least 60° C.

10. The process of claim 1 including the additional steps of:

immersing the activated strip into another pickling tank containing the inorganic acid, and applying the aqueous solution to the strip after being pickled in the other pickling tank.

11. The process of claim 9 wherein the second tank contains 100–200 g/l of the inorganic acid and a temperature of at least 77° C.

12. The process of claim 11 wherein the acid in the pickling tanks is counter current flowed through the pickling tanks in a direction opposite the direction of travel of the strip.

13. The process of claim 1 wherein the aqueous solution after activating the strip is mixed with a waste water containing dissolved ferrous iron to break down any free hydrogen peroxide.

14. The process of claim 1 wherein the aqueous solution after activating the strip is mixed with the inorganic acid containing dissolved ferrous iron to break down any free hydrogen peroxide.

15. The process of claim 1 wherein the pickled strip is brushed to loosen any residual scale not removed by the inorganic acid.

16. The process of claim 1 wherein the strip is hot rolled or annealed ferritic stainless steel.

17. The process of claim 1 wherein the pretreatment is shot blasting.

18. A process for removing scale from a ferrous alloy containing chromium, comprising:

providing a ferrous alloy strip containing chromium covered by scale, pretreating the strip to crack the scale, immersing the pretreated strip into at least one pickling tank containing an inorganic acid from the group consisting of hydrochloric and sulfuric acid to remove the cracked scale thereby forming a pickled strip, and applying an aqueous solution free of dissolved iron containing at least about 20 g/l hydrogen peroxide and at least about 5 g/l of the inorganic acid to the pickled strip wherein any residual scale on the pickled strip becomes activated by the peroxide and simultaneously removed by the inorganic acid contained in the aqueous solution thereby forming a clean strip.

19. A process for removing scale from a ferrous alloy containing chromium, comprising:

providing a stainless steel strip covered by scale, pretreating the strip to crack the scale, immersing the pretreated strip into at least one pickling tank containing at least 50 g/l of inorganic acid at a temperature of at least 77° C. to remove the cracked scale thereby forming a pickled strip, applying an aqueous solution free of dissolved iron containing at least about 20 g/l of hydrogen peroxide and at least about 20 g/l of the inorganic acid to activate any residual scale on the strip, immersing the activated strip into another pickling tank containing at least 50 g/l of the inorganic acid at a temperature of at least 77° C. to remove any activated residual scale, and applying the aqueous solution containing at least about 20 g/l of the hydrogen peroxide and at least about 20 g/l inorganic acid to the pickled strip wherein any residual scale on the pickled strip becomes activated by the hydrogen peroxide and simultaneously removed by the inorganic acid contained in the aqueous solution thereby forming a clean strip.

* * * * *